US005296826A

United States Patent [19]

Hart et al.

[11] Patent Number: 5,296,826

[45] Date of Patent: Mar. 22, 1994

[54] SWITCH ASSEMBLY

[75] Inventors: Roy L. Hart, Laguna Niguel; Yusuke P. Okabayashi, Costa Mesa, both of Calif.

[73] Assignee: Eaton Corporation, Cleveland, Ohio

[21] Appl. No.: 61,835

[22] Filed: May 13, 1993

[51] Int. Cl.[5] ..... H01H 67/02

[52] U.S. Cl. ..... 335/132; 335/185

[58] Field of Search ..... 335/131, 132, 78–86, 335/185–189

[56] References Cited

U.S. PATENT DOCUMENTS

| | | | |
|---|---|---|---|
| 3,315,535 | 4/1967 | Stevens . | |
| 3,942,143 | 3/1976 | Pollmann et al. | 335/202 |
| 4,086,550 | 4/1978 | Conner | 335/202 |
| 4,496,813 | 1/1985 | Fukushima . | |
| 4,973,929 | 11/1990 | Duchemin | 335/132 |
| 5,233,321 | 8/1993 | Blanchard et al. | 335/132 |

*Primary Examiner*—Lincoln Donovan

*Attorney, Agent, or Firm*—Tarolli, Sundheim & Covell

[57] ABSTRACT

A switch assembly includes a switch actuator assembly which is operable to actuate a plurality of switches. The switch actuator assembly includes a pushbutton which is manually depressed to move a core relative to a coil from a first position to a second position. As the core moves to the second position, the plurality of switches are actuated and a magnetic field from the core cooperates with a base or frame member to hold the core in the second position. As the pushbutton returns to its unactuated position, a force transmitting lever moves into an extended position in engagement with a coil switch actuator arm. Subsequent depressing of the pushbutton causes a drive pin connected with the pushbutton to depress the force transmitting lever to open a coil switch and deenergize the coil. As the pushbutton is subsequently released, the core and drive pin move upwardly. The coil switch then closes and a retainer pin connected with the core pushes the force transmitting lever back to a retracted position. A remote switch is provided to interrupt a circuit for energizing the coil.

15 Claims, 6 Drawing Sheets

SWITCH ASSEMBLY

BACKGROUND OF THE INVENTION

The present invention relates to a switch assembly for use in electrical circuitry.

A known switch assembly for use in electrical circuitry is disclosed in U.S. patent application Ser. No. 951,669, filed Sep. 25, 1992 by Mohabbatizadeh et al. and entitled "Switch Assembly". The switch assembly disclosed in the aforesaid application includes a manually actuatable member which is movable relative to a switch housing to effect operation of an actuator assembly between unactuated and actuated conditions. A holding coil is energizeable to maintain the actuator assembly and switches in their actuated conditions. A control assembly is effective to control energization of the holding coil in response to movement of the manually actuatable member.

In one embodiment of the switch assembly illustrated in the aforementioned application Serial No. 951,669, the control assembly includes optical sensors which cooperate with shutters to control the output from the control assembly. The shutters move with the manually actuatable member and are effective to cause a change in the condition of the optical sensors upon movement of the manually actuatable member. The shutters change the condition of the optical sensors in a manner which effects energization or deenergization of the holding coil only in response to movement of the manually actuatable member through a complete operating stroke.

SUMMARY OF THE INVENTION

An improved switch assembly includes switch contacts which are operable between unactuated and actuated conditions. At least a portion of an electromagnetic holding device is movable from a first position to a second position by a manually actuatable member. An electromagnetic field cooperates with a base member to retain the portion of the electromagnetic holding device in the second position.

Upon movement of the portion of the electromagnetic holding device to the second position, the switch contacts are actuated. The switch contacts are retained in the actuated condition while the portion of the electromagnetic holding device is in the second position.

The manually actuatable member is movable back to an initial position with the portion of the electromagnetic holding device in the second position. A switch is provided to effect operation of the electromagnetic holding device to a deenergized condition upon subsequent actuation of the manually actuatable member. This enables the portion of the electromagnetic holding device to move back toward its first position and the switches to operate to an unactuated condition as the manually actuatable member is returned to its initial position.

BRIEF DESCRIPTION OF THE DRAWINGS

The foregoing and other features of the present invention will become more apparent upon a consideration of the following description taken in connection with the accompanying drawings, wherein.

DESCRIPTION OF ONE SPECIFIC PREFERRED EMBODIMENT OF THE INVENTION

General Description

Figure 1:
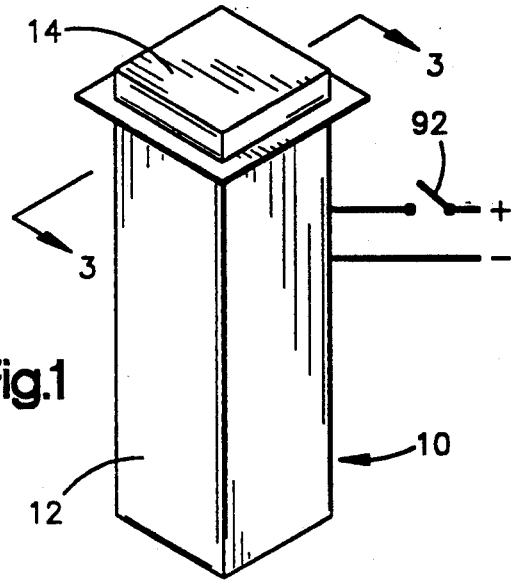
FIG. 1 is a pictorial illustration of a switch assembly constructed in accordance with the present invention.

A switch assembly 10 (FIG. 1) includes a rectangular housing 12 and a manually actuatable pushbutton 14. The switch assembly 10 may be used in either an alternate action mode of operation or a momentary action mode of operation. When the switch assembly 10 is used in an alternate action mode of operation, depressing the pushbutton 14 through its operating stroke actuates switches 16 (FIG. 2) disposed in the housing 12 from a first or unactuated condition to a second or actuated condition. When the pushbutton 14 is released, the switches 16 remain in the second or actuated condition. When the pushbutton 14 is again depressed through its operating stroke and released, the switches 16 change from the second or actuated condition back to the first or unactuated condition.

When the switch assembly 10 is used in a momentary action mode of operation, initially depressing the pushbutton 14 through its operating stroke actuates the switches 16 from the first or unactuated condition to the second or actuated condition. When the pushbutton is released, the switches 16 change from the second or actuated condition back to the first or unactuated condition. Thus, when the switch assembly 10 is used in the momentary actuation mode of operation, the switches 16 are maintained in an actuated condition only when the pushbutton 14 is depressed.

The pushbutton 14 in the switch assembly 10 has an axially downwardly (a viewed in FIG. 2) extending plunger or drive member 20. The plunger or drive member 20 has a generally cylindrical configuration with flat surface formed on one side, that is, facing toward the left and into the sheet of drawings (as viewed in FIG. 2). A drive pin 22 is fixedly connected to the plunger 20 and extends perpendicular to a longitudinal central axis of the plunger. Biasing springs 24 are provided to urge the pushbutton 14 upwardly (as viewed in FIGS. 1 and 2) toward an unactuated position.

Figure 2:
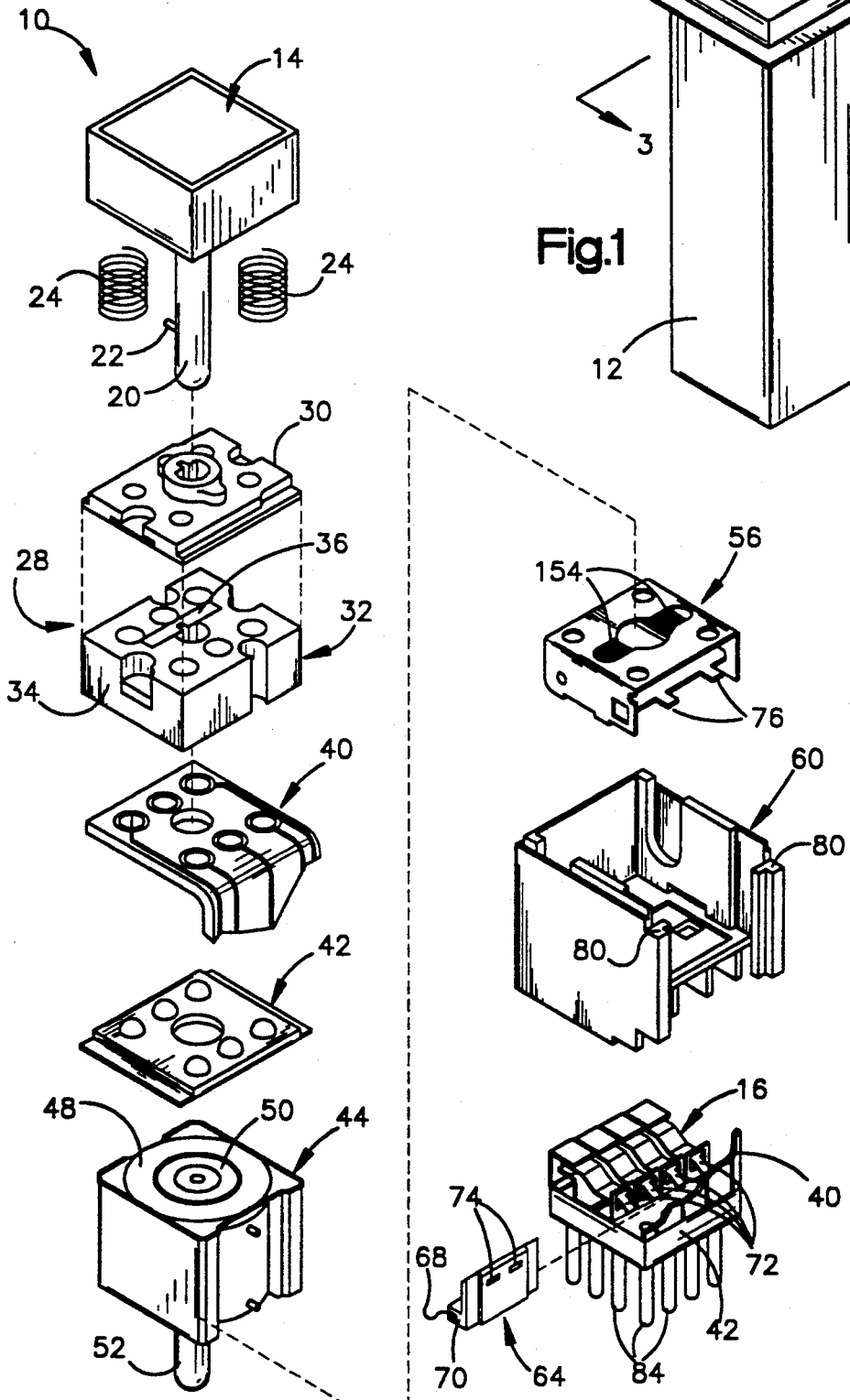
FIG. 2 is a simplified and exploded pictorial illustration of some of the components of the switch assembly of FIG. 1.

The plunger 20 extends through a rectangular housing 28 (FIG. 2). The housing 28 has an upper end cover 30 and a main housing section 32. The main housing section 32 includes a block 34 of insulating material. An insert 36 in the block 34 holds a force transmitting lever and coil switch. The function of the force transmitting lever and coil switch will be further explained hereinafter.

A flexible printed circuit 40 interconnects a terminal block 42 upon which the switches 16 are mounted and contacts (not shown) which extend through the housing 28 to the pushbutton 14 to illuminate display lamps in the pushbutton in a known manner. An insulator 42 insulates the printed circuit 40 from an electromagnetic holding device 44 and positions the printed circuit relative to the electromagnetic holding device.

The electromagnetic holding device 44 includes a generally cylindrical coil 48 which extends around a generally cylindrical core 50. A cylindrical plunger 52 extends axially downwardly (as viewed in FIG. 2) from the core 50. A spring assembly 56 applies force to the plunger 52 to bias the core 50 upwardly relative to the coil 48.

The spring assembly 56 and the switches 16 (FIG. 2) are enclosed by a switch actuator housing 60. The switch actuator housing 60 is disposed within the main housing 12 (FIG. 1) of the switch assembly 10. The spring assembly 56 is constructed in the manner disclosed in U.S. Pat. No. 3,315,535.

A connector member 64 interconnects the switches 16 and the spring assembly 56. The connector member 64 has a generally L-shaped configuration. A slot 68 formed in a short leg 70 of the connector member 64 engages end portions of switch arms 72 of the switches 16.

The connector member 64 has a pair of openings or slots 74 which are engaged by a pair of arms 76 extending outwardly from the spring assembly 56. The connector member 64 is slidably received in guides 80 formed in the switch actuator housing 60. The guides 80 guide vertical (as viewed in FIG. 2) movement of the connector member 64 relative to the housing 60.

When the spring assembly 56 is actuated to move the arms 144 downwardly and arms 76 upwardly, the connector member 64 is moved upwardly. After the connector member 64 has moved downwardly through a relatively short distance, the switches 16 are actuated with a snap action from an initial or unactuated condition to a second or actuated condition. The switches 16 are connected with suitable circuitry through terminals 84 on the terminal block 42. The switches 16 may have any one of many different known snap action constructions, such as the construction disclosed in U.S. Pat. No. 4,496,813.

Switch Actuator Assembly

An improved switch actuator assembly 90 (FIG. 3) is constructed and operated in accordance with the present invention. The switch actuator assembly 90 is operable to actuate the switches 16 (FIG. 2) with either an alternate action mode of operation or a momentary action mode of operation. When a remote switch 92 (FIG. 3) is closed, the switch actuator assembly 90 has an alternate action mode of operation. When the remote switch 92 is open, the switch actuator assembly 90 has a momentary action mode of operation.

The switch actuator assembly 90 includes the electromagnetic holding device 44. Control apparatus 96 cooperates with a coil switch 98 (FIG. 3) to control energization of the coil 48 in the electromagnetic holding device 44. During operation of the switch assembly 10 in the momentary action mode of operation, the remote switch 92 is open and the coil 48 is continuously deenergized. During operation of the switch assembly 10 in its alternate action mode of operation, the remote switch 92 is closed and the coil 48 is deenergized only when the coil switch 98 is open.

In addition to the cylindrical coil 48, the electromagnetic holding device 44 includes the cylindrical core 50 (FIG. 3) which is movable relative to the stationary coil. Thus, the core 50 is movable between a first or upper position (FIG. 3) in which the switches 16 (FIG. 2) are in an unactuated condition, and a second or lower position (FIG. 4) in which the switches 16 are in an actuated condition. The annular coil 48 circumscribes at least a portion of the core 50 when the core is in the first or upper position (FIG. 3) and the second or lower position (FIG. 4).

Figure 4:
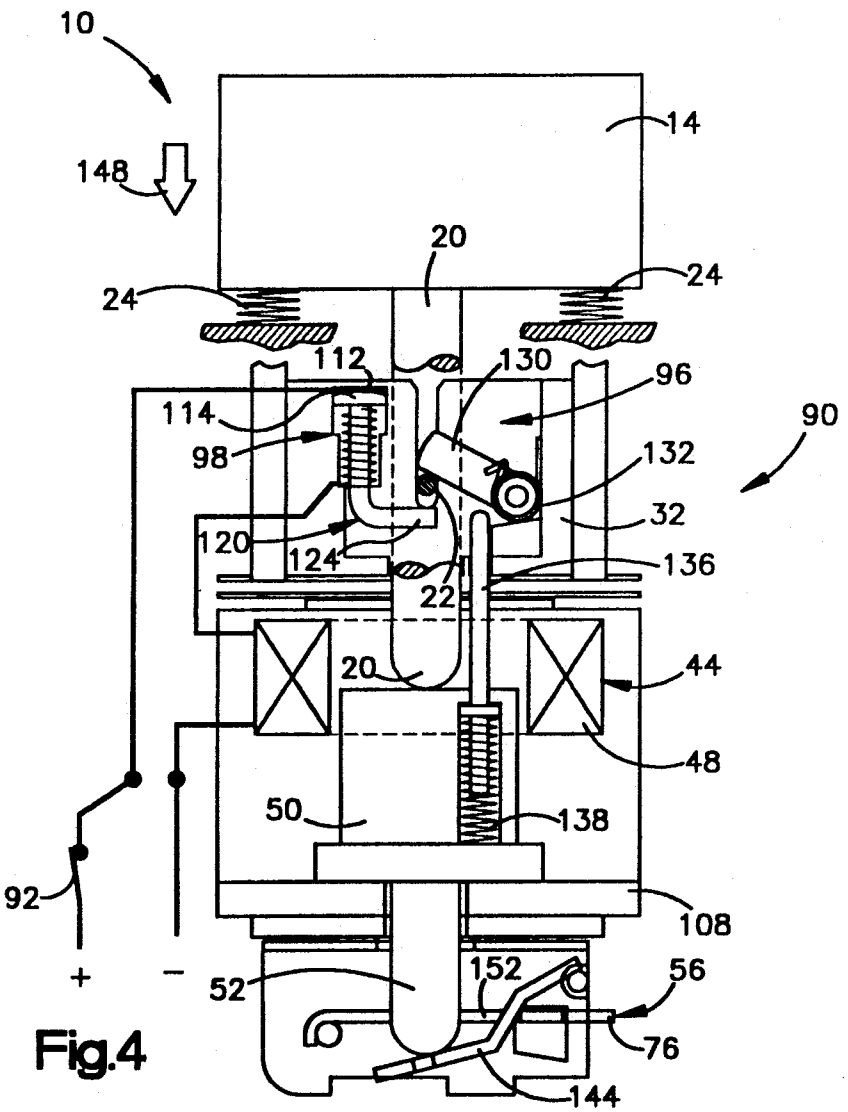
FIG. 4 is a fragmentary schematic illustration, generally similar to FIG. 3 but on a reduced scale, illustrating the switch assembly in an actuated condition in which switches in the switch assembly are actuated.

When the core 50 is in the second or lower position, the core is adjacent to an iron base or frame member 108 (FIG. 4). The base or frame member 108 is formed of a magnetizable material, that is, iron. The base member 108 cooperates with the coil 48 to provide a path for a relatively strong magnetic field which emanates from the coil 48 and is conducted through the core 50 and frame 108 back to the coil.

Once the core 50 has moved to the second or lower position adjacent to the base member 108 (FIG. 4), the core will remain in the lower position as long as the coil 44 is energized. The coil 48 is energized by electrical energy conducted through the closed remote switch 92 and the closed coil switch 98. When the core 50 is in the first or upper position (FIG. 3), the magnetic attraction between the core 50 and the base member 108 is insufficient to move the core downwardly (as viewed in FIG. 3) against the influence of the spring assembly 56. Therefore, until the pushbutton 14 is depressed to move the core 50 downwardly, the core remains in the first or upper position with the coil 48 energized.

The coil switch 98 controls energization and deenergization of the coil 48 when the remote switch 92 is closed. The coil switch 98 includes a stationary switch contact 112 (FIG. 3) and a movable switch contact 114. A helical coil biasing spring 116 urges the movable switch contact 114 into engagement with the fixed switch contact 112.

An L-shaped actuator arm 120 is connected with the movable switch contact 114. The actuator arm 120 is movable downward (as viewed in FIG. 3) to move the movable switch contact 114 out of engagement with the fixed switch contact 112. The L-shaped actuator arm 120 has a relatively long leg 122 which is connected with the movable switch contact 114 and a relatively short leg 124 which projects outward and rightward (as viewed in FIG. 3) from the long leg 122.

When the movable switch contact 114 moves downward away from the fixed switch contact 112 (FIG. 8), the electrical circuit for energizing the coil 48 is interrupted to deenergize the coil. Upon deenergization of the coil 48, the magnetic field emanating from the coil is also interrupted.

Figure 8:
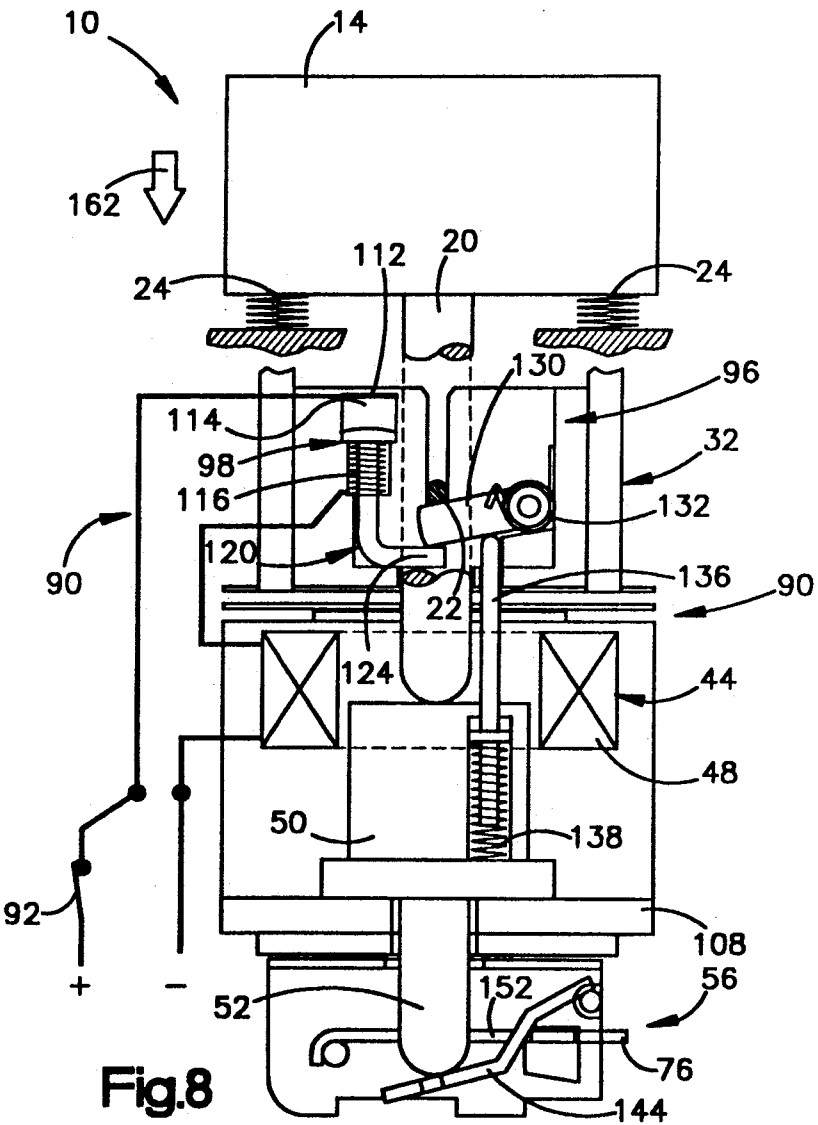
FIG. 8 is a fragmentary schematic illustration, generally similar to FIG. 7, illustrating the switch assembly in an actuated condition in which the electromagnetic holding device is deenergized while the switches remain in an actuated condition.

The control apparatus 96 (FIG. 3) includes a force transmitting or timing lever 130. The force transmitting lever 130 is pivotally mounted on the housing section 36. The force transmitting lever 130 is pivotal between a retracted position (FIG. 3) and an extended position (FIG. 8). A torsion-type coil spring 132 (FIG. 3) urges the force transmitting lever 130 to pivot in a counterclockwise direction as viewed in FIG. 3.

A cylindrical retainer pin 136 (FIG. 3) is mounted on the core 50. The retainer pin 136 is effective to maintain the force transmitting lever 130 in the retracted position (FIG. 3) against the influence of the coil spring 132 when the core 50 is in the first or upper position. Upon movement of the core 50 to the second or lower position (FIG. 4), the retainer pin 136 moves downwardly away from the force transmitting lever 130 to release the lever for pivotal movement under the influence of the spring 132.

Figure 3:
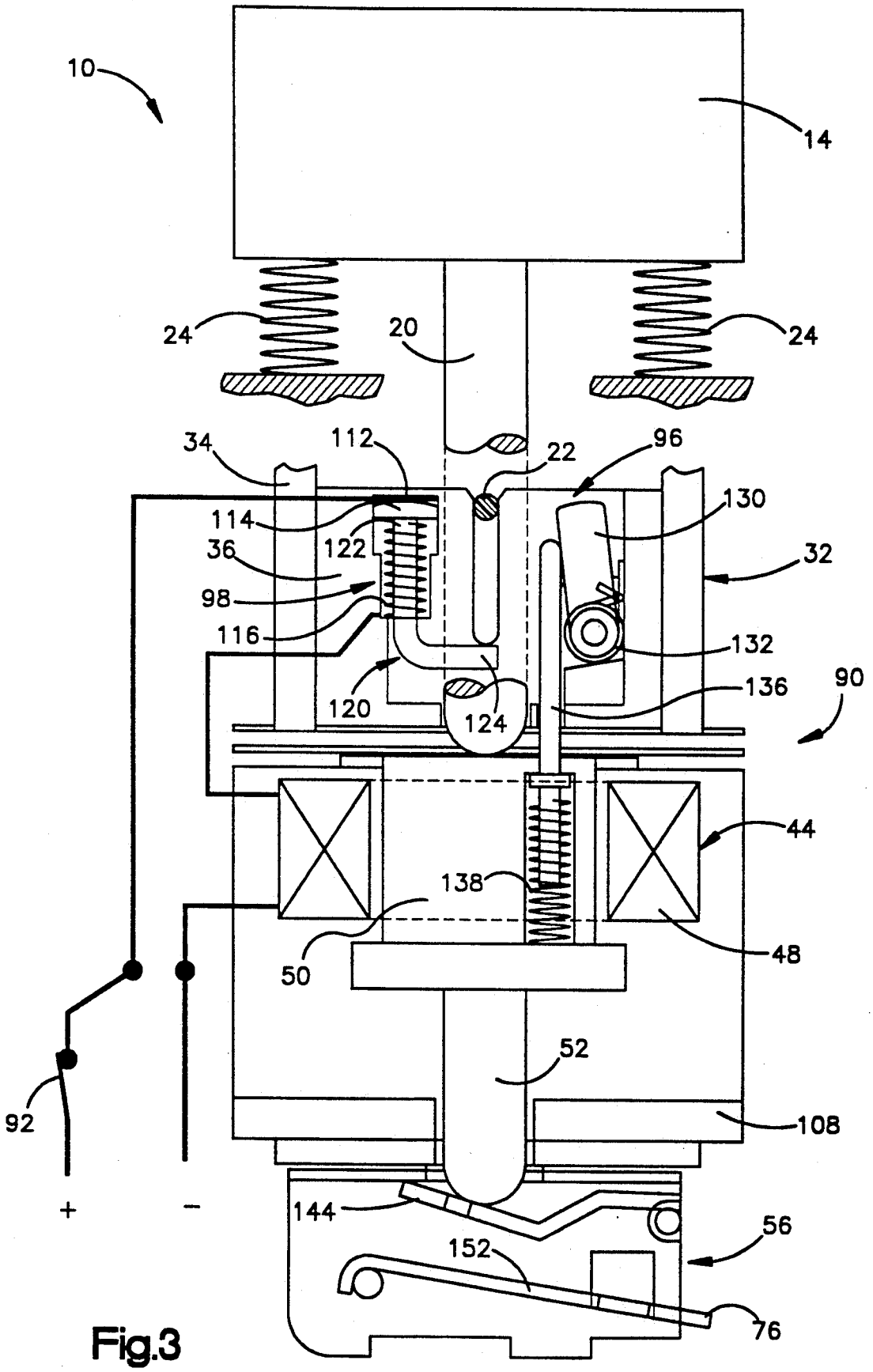
FIG. 3 is an enlarged fragmentary schematic illustration, taken generally along the line 3—3 of FIG. 1, further illustrating the construction of the switch assembly, the switch assembly being shown in FIG. 3 in an initial or released-unactuated condition in which switches in the switch assembly are unactuated.

A helical coil spring 138 (FIG. 3) urges the retainer pin 136 toward the extended position, shown in FIG. 3, in which the retainer pin blocks movement of the force transmitting lever 130 from the retracted position. The helical spring 138 which urges the retainer pin 136 toward the extended position and the helical spring 116 which urges the movable switch contact 114 into engagement with the fixed switch contact 112 are both stronger than the torsion spring 132 which urges the force transmitting lever 130 away from the retracted position of FIG. 3.

Operation

The switch assembly 10 is shown in an initial or released-unactuated condition in FIG. 3. Since the remote switch 92 is closed, the switch assembly 10 will be operated in its alternate action mode of operation. When the switch assembly 10 is in the unactuated condition shown in FIG. 3, the projections 76 (FIG. 2) from the spring assembly 56 are in the lowered position and the switches 16 are in an unactuated condition. When the switch assembly 10 is in the initial condition of FIG. 3, a spring biased arm 144 in the spring assembly 56 is pressed upwardly by coil springs 154 (FIG. 2), to maintain the core 50 in the raised position.

The coil switch 98 is closed when the switch assembly 10 is in the initial condition of FIG. 3. Since the remote switch 92 is also closed, the coil 48 in the electromagnetic holding device 44 is energized. However, the distance between the core 50 and the base member 108 is sufficient to prevent the core from being pulled downwardly by the cooperation between the magnetic field transmitted from the coil 48 through the core to the base member.

When the switch assembly is in the initial condition of FIG. 3, the retainer pin 136 presses against the force transmitting lever 130. At this time, the retainer pin 136 holds the force transmitting lever 130 in the retracted position against the influence of the torsion spring 132 The pushbutton 14 is urged to a raised or unactuated position by the springs 24.

To actuate the switches 16 (FIG. 2), the pushbutton 14 is manually moved downward from the unactuated position shown in FIG. 3 to the actuated position shown in FIG. 4. Thus, downward force, indicated schematically by the arrow 148 in FIG. 4, is applied against the pushbutton 14. The force applied against the pushbutton 14 causes the pushbutton to move downward to the actuated position shown in FIG. 4.

As the pushbutton 14 moves downward, the plunger 20 moves the core 50 downward to the second or lowered position shown in FIG. 4. When the core 50 moves to the lowered position shown in FIG. 4, it is disposed in abutting engagement with the base member 108. Therefore, the magnetic field emanating from the coil 48 is conducted through the core 50 and base member 108 to hold the core in the second or lowered position. If desired, the core 50 may be spaced from the base member 108 by a layer of nonmagnetizeable material.

As the core 50 moves to the second or lowered position, the core plunger 52 moves the arm 144 in the spring assembly 56 downward from the initial position of FIG. 3 to the actuated position of FIG. 4. As the arm 144 in the spring assembly 56 moves downward, a second arm 152 in the spring assembly is moved upward. This upward movement of the arm 152 in the spring assembly 56 raises the connector member 64 (FIG. 2) to operate the switches 16 from their unactuated condition to their actuated condition. Compression snap action springs 154 (FIG. 2) are interpositioned between the arms 144 and 152 in the manner disclosed in U.S. Pat. No. 3,315,535.

As the pushbutton 14 moves downward from the unactuated position of FIG. 3 to the actuated position of FIG. 4, the drive pin 22 moves downward with the pushbutton 14 and the core 50. As the core 50 moves downward, the retainer pin 136 moves downward to release the force transmitting lever 130 for movement from the retracted position of FIG. 3. However, before the force transmitting lever 130 is released by the retainer pin 136 for movement from the retracted position of FIG. 3, the drive pin 22 will have moved below the upper or free end portion of the force transmitting lever. Therefore, the torsion spring 132 is effective to pivot the force transmitting lever 130 into abutting engagement with the upper side of the drive pin 22, in the manner illustrated in FIG. 4.

As the pushbutton 14, drive pin 22 and core 50 move downward from the initial or unactuated condition shown in FIG. 3 to the actuated condition shown in FIG. 4, the coil switch 98 remains closed or unactuated. Thus, the movable switch contact 114 remains stationary in engagement with the fixed contact 112. The downward movement of the drive pin 22 stops short of the relatively short horizontal arm 124 of the L-shaped coil switch actuator arm 120. Therefore, the coil 48 remains energized. The magnetic field emanating from the coil 48 is transmitted through the core 50 to the base member 108 to hold the core in the second or lowered position of FIG. 4.

After the pushbutton 14 has been manually depressed to the actuated position of FIG. 4, the pushbutton is released. The springs 24 urge the pushbutton 14 upward, in the manner indicated schematically by the arrow 156 in FIG. 5, toward the unactuated position. As the pushbutton 14 moves upward, the coil switch 98 remains closed and the coil 48 remains energized. Therefore, cooperation between the magnetic field emanating from the coil 48 and transmitted through the core 50 to the base member 108 holds the core 50 stationary in the lowered or second position of FIG. 5. As long as the core 50 remains in the lowered or second position of FIG. 5, the switches 16 (FIG. 2) remain actuated.

Figure 5:
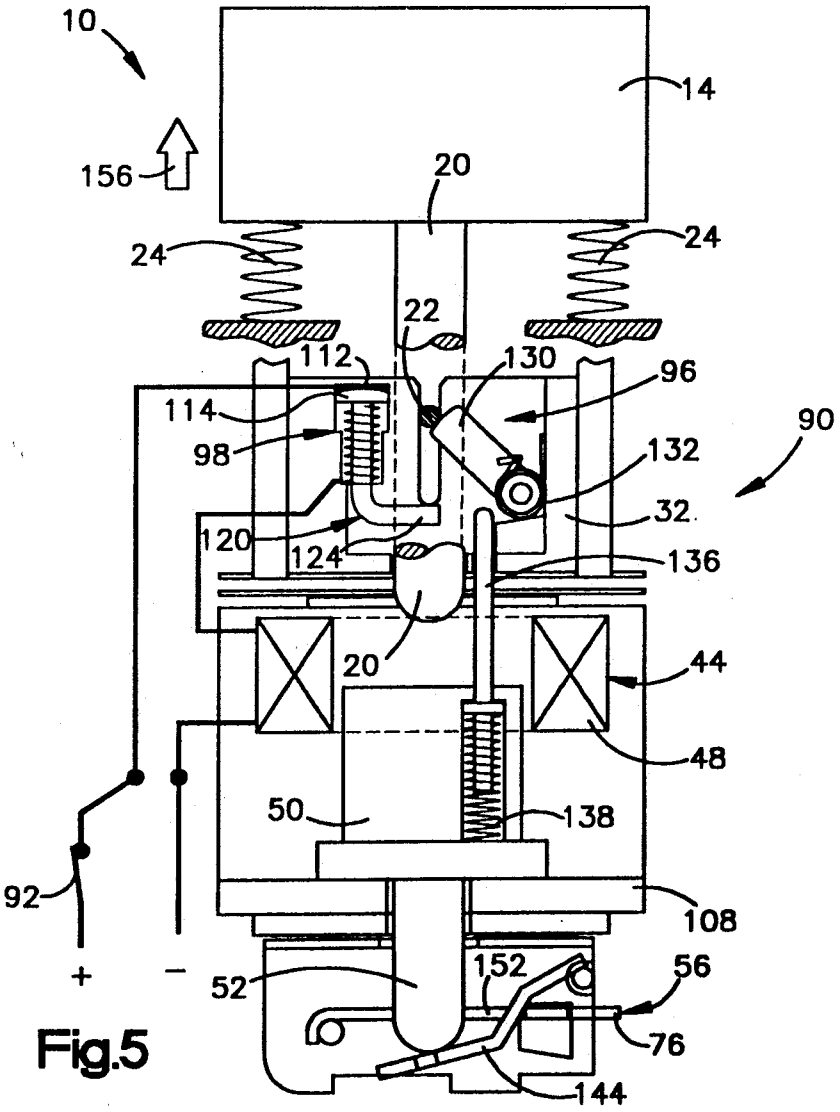
FIG. 5 is a fragmentary schematic illustration, generally similar to FIG. 4, illustrating the switch assembly in a partially released condition in which an electromagnetic holding device maintains the switches in an actuated condition.

As the pushbutton 14 moves upward, the drive pin 22 moves upward to pivot the force transmitting lever 130 in a clockwise direction from the position of FIG. 4 to the position of FIG. 5, against the influence of the relatively weak torsion spring 132. Thus, the force transmitting lever 130 moves back toward the retracted position. As the drive pin 22 and pushbutton 14 move slightly upward from the position shown in FIG. 5 back toward the unactuated position shown in FIG. 6, the drive pin 22 moves clear of the upper end portion of the force transmitting lever 130. When this happens, the torsion spring 132 pivots the force transmitting lever 130 in a counterclockwise direction from the position shown in FIG. 5 to the position shown in FIG. 6.

Figure 6:
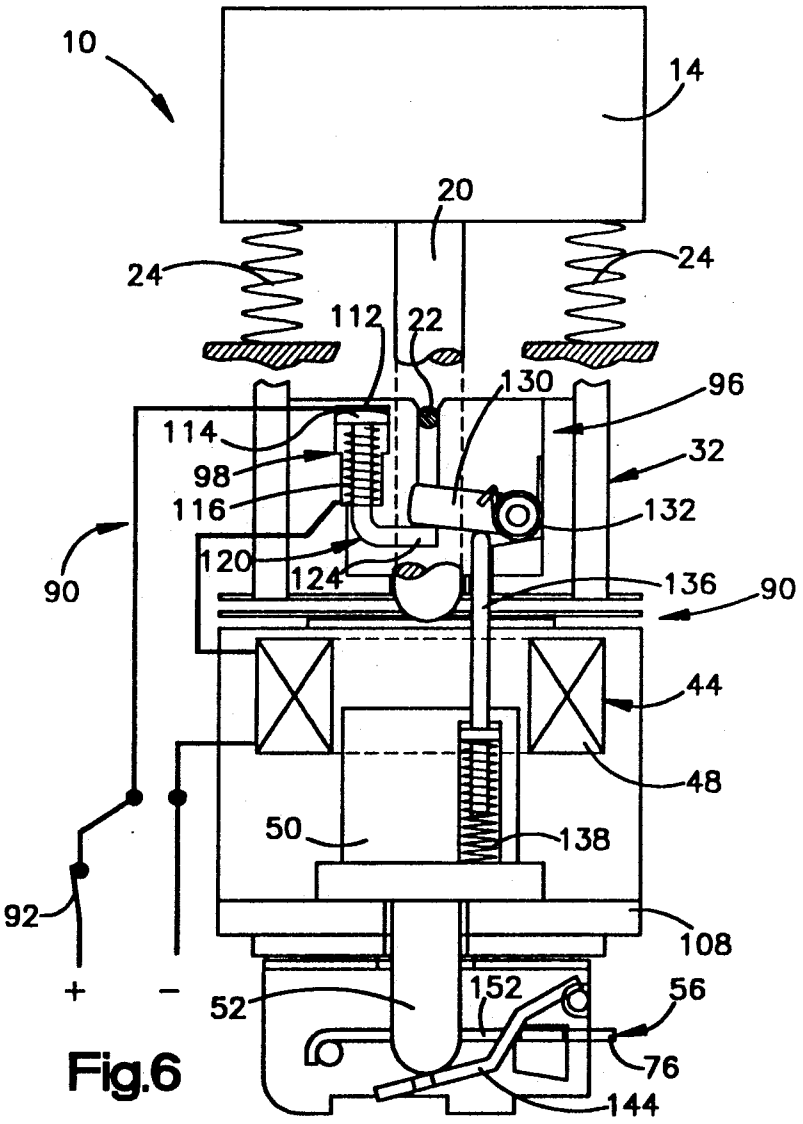
FIG. 6 is a fragmentary schematic illustration, generally similar to FIG. 5, illustrating the switch assembly in a released-actuated condition in which the electromagnetic holding device continues to maintain the switches in the actuated condition.

As the force transmitting lever 130 approaches the position shown in FIG. 6, a lower edge portion of the force transmitting lever engages the upper end of the retainer pin 136. Even though the retainer pin biasing spring 13 is stronger than the force transmitting lever biasing spring 132, the retainer pin 136 is depressed slightly, in the manner illustrated in FIG. 6, by the kinetic energy of the downwardly swinging force transmitting lever 130.

As the retainer pin 136 is depressed and absorbs the kinetic energy of the downwardly or counterclockwise pivoting force transmitting lever 130, the force transmitting lever comes into engagement with the relatively short leg 124 of the L-shaped switch actuator arm 120. Since the retainer pin 136 has already absorbed most of the kinetic energy of the downwardly swinging force transmitting lever 130, the force applied against the L-shaped actuator arm 120 by the force transmitting lever 130 is ineffective to move the L-shaped switch actuator arm 120 against the influence of the biasing spring 116 (FIG. 6). Therefore, the movable contact 114 in the coil switch 98 remains stationary in engagement with the fixed contact 112 of the coil switch 98.

When the pushbutton 14 has returned to the unactuated position shown in FIG. 6, the coil 48 remains energized. Therefore, the core 50 is held in the second or lowered position against the influence of the spring assembly 56 by the cooperation between the electromagnetic field from the coil 48 and the base member 108. The switches 16 remain actuated.

Figure 7:
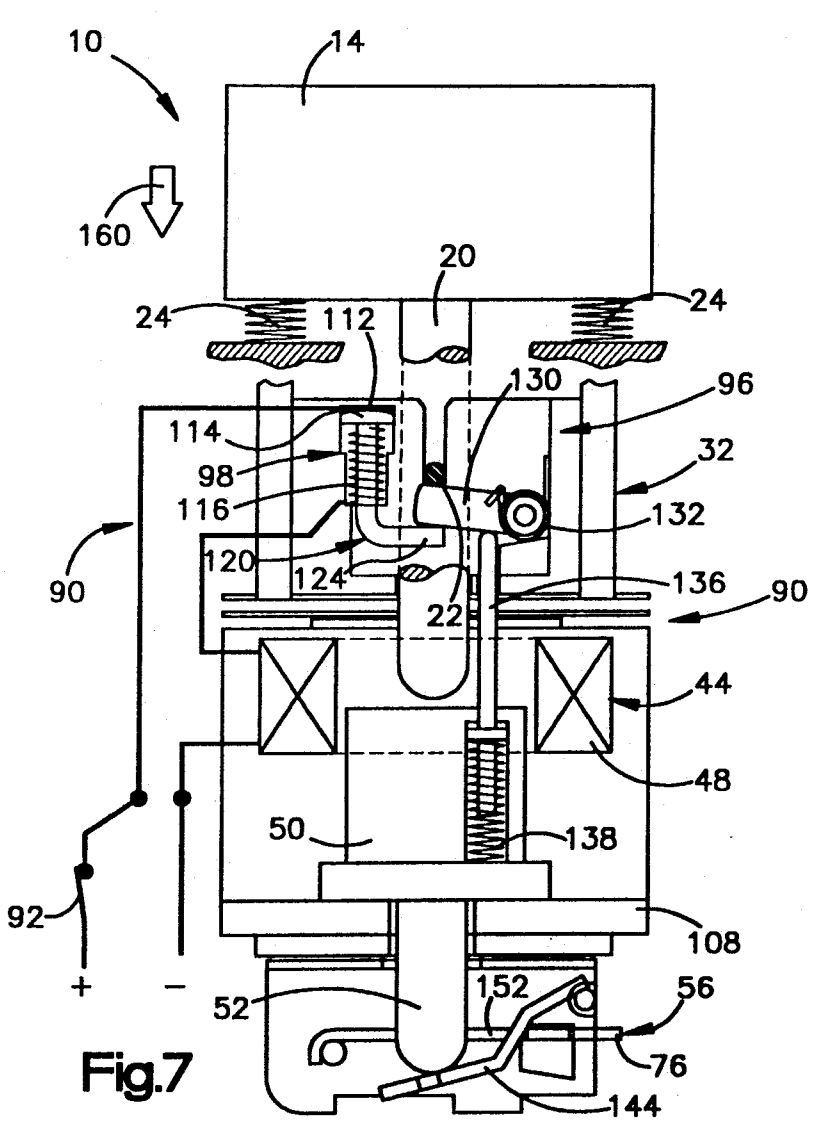
FIG. 7 is a fragmentary schematic illustration, generally similar to FIG. 6, illustrating the switch assembly in a partially actuated condition in which the electromagnetic holding device continues to maintain the switches in an actuated condition.

When it is desired to return the switches 16 to their unactuated condition, the pushbutton 14 is again depressed by the application of manual force to the pushbutton, in the manner indicated schematically by the arrow 160 in FIG. 7. As the pushbutton 14 and drive pin 22 move downwardly from the unactuated position shown in FIG. 6 to the partially actuated position shown in FIG. 7, the lower side of the drive pin 22 moves into engagement with the upper side of the force transmitting lever 130. At this time, the coil switch 98 is closed and the coil 48 is energized. Therefore, at this time, the switches 16 remain actuated.

As the pushbutton 14 continues to be manually pressed downward, in the manner indicated schematically by the arrow 162 in FIG. 8, the lower side of the drive pin 22 presses against the upper side of the force transmitting lever 130 and pivots the force transmitting lever in a counterclockwise direction. As this occurs, the retainer pin 136 is forced downward from the position shown in FIG. 7 to the position shown in FIG. 8 against the influence of the retainer pin biasing spring 138. At the same time, the force transmitting lever 130 applies force against the relatively short leg 124 of the L-shaped coil switch actuator arm 122 to move the actuator arm downward (as viewed in FIG. 8) against the influence of the coil switch biasing spring 116. As this occurs, the movable coil switch contact 114 is pulled downward away from the fixed coil switch contact 112 to interrupt the circuit for energizing the coil 48.

Deenergization of the coil 48 interrupts the magnetic field which had previously cooperated with the base member 108 to hold the core 50 in the second or lower position against the influence of the spring assembly 56. However, as the pushbutton 14 is moved downward to the actuated position of FIG. 8, the plunger 20 moves into engagement with the core 50. Therefore, force is transmitted from the pushbutton 14 through the plunger 20 to hold the core in the second or lower position against the influence of the spring assembly 56 even though the coil 48 has been deenergized. Therefore, the switches 16 remain in the actuated condition when the pushbutton 14 is in the actuated position of FIG. 8.

Figure 9:
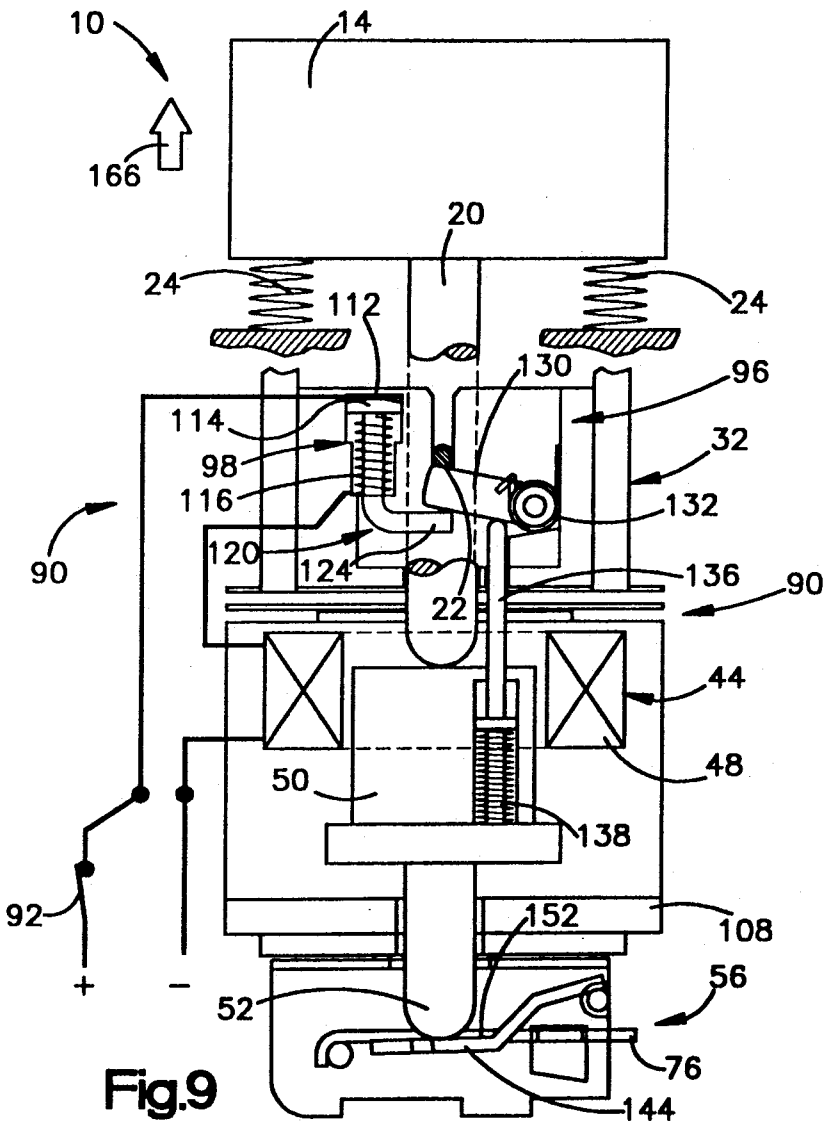
FIG. 9 is a fragmentary schematic illustration, generally similar to FIG. 8, illustrating the switch assembly in a partially released condition in which the electromagnetic holding device is again energized and the switches remain in an actuated condition.

As the pushbutton is manually released, springs 24 urge the pushbutton upward away from the actuated position of FIG. 8, in the manner indicated schematically by the arrow 166 in FIG. 9. During the initial portion of the upward movement of the pushbutton 14, the core 50 moves upward away from the frame member 108. As this occurs, the arm 144 in the switch assembly 56 moves upward. However, the other arm 152 in the spring assembly 56 remains stationary so that the switches 16 remain in their actuated condition.

During upward movement of the pushbutton 14 from the position shown in FIG. 8 to the position shown in FIG. 9, the drive pin 22 moves upward with the pushbutton. As the drive pin 22 moves upward, the retainer biasing spring 138 in conjunction with the retainer pin 136 pivots the force transmitting lever 130 in a clockwise direction against the counterclockwise force of the torsion spring 132 from the position shown in FIG. 8 to the position shown in FIG. 9. However, the force transmitting lever 130 is held against pivoting movement to the retracted position of FIG. 3 by engagement of the force transmitting member with the lower side of the drive pin 22.

As the force transmitting lever 130 pivots upward from the position shown in FIG. 8 to the position shown in FIG. 9, the L-shaped actuator arm 120 is moved upward by the coil switch biasing spring 116. This upward movement of the actuator arm 120 moves the coil switch contact 114 into engagement with the fixed coil switch contact 112 to again complete the circuit to energize the coil 48. Although the coil 48 is again energized, the space between the lower end of the core 50 and the frame member 108 prevents the core from being drawn back downward by the cooperation between the magnetic field and the frame member.

If the direction of movement of the pushbutton 14 is reversed and the pushbutton is in the position shown in FIG. 9, the plunger 20 will move the core 50 back downward into engagement with the base member 108. As the pushbutton 14 and core 50 are moved downward, the drive pin 22 will pivot the force transmitting lever 130 in a counterclockwise direction to again actuate the coil switch 98 to the open condition. Therefore, the circuit for energizing the coil 48 is again interrupted and the coil is deenergized. Therefore, upon subsequent movement of the pushbutton 14 back to the position shown in FIG. 9, the core 50 moves upward away from the base member 108 and the force transmitting lever 130 will again pivot upward and the coil switch 98 is closed to again energize the coil 48.

Figure 10:
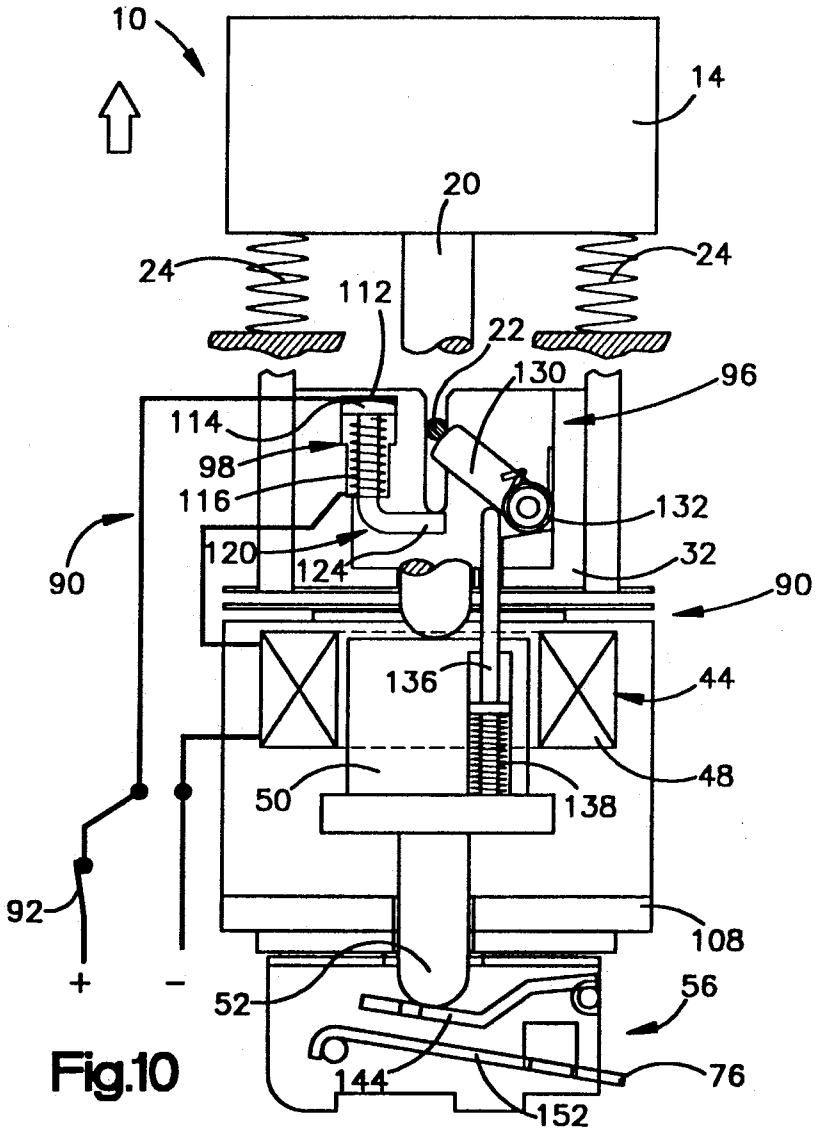
FIG. 10 is fragmentary schematic illustration, generally similar to FIG. 9, illustrating the switch assembly in a partially released condition in which the electromagnetic holding device is energized and the switches are in an unactuated condition.

As the pushbutton 14 continues to be manually released, the pushbutton 14 and core 50 continue to move upward from the position shown in FIG. 9 to the position shown in FIG. 10. As this occurs, the retainer pin 136 is pressed against the lower edge of the force transmitting lever 130 to compress the retainer pin biasing spring 138 (FIG. 10). In addition, the drive pin 22 moves to a position where it is almost, but not quite, clear of the free or upper end portion of the force transmitting lever 130. Therefore, the drive pin 22 continues to hold the force transmitting lever against pivoting movement to the retracted position shown in FIG. 3.

The next increment of upward movement of the pushbutton 14 from the position shown in FIG. 10 results in the drive pin 22 moving clear of the outer end of the force transmitting lever 130. When this occurs, the relatively strong retainer pin biasing spring 138 immediately causes the retainer pin 136 to move upward to pivot the force transmitting lever 130 back to the retracted position shown in FIG. 3. Since the retainer pin biasing spring 138 is stronger than the relatively weak torsion spring 132, the retainer pin biasing spring 138 can overcome the influence of the torsion spring 132 and pivot the force transmitting lever 130 in a clockwise direction from the position shown in FIG. 10 to the fully retracted position shown in FIG. 3.

As the pushbutton 14 and core 50 move upward to the position shown in FIG. 10, the arm 144 in the spring assembly 56 moves upward. As this occurs, the arm 152 in the spring assembly 56 snaps downward to actuate the switches 16 for snap action operation from the actuated condition to the unactuated condition. Continued upward movement of the pushbutton 14 and core 50 results in the switch assembly 10 returning to the initial or unactuated condition shown in FIG. 3.

When the switch assembly 10 is to be operated in the momentary actuation mode, the remote switch 92 is opened, in the manner shown in FIG. 1. Opening the remote switch 92 interrupts the circuit for energizing the coil 48. Therefore, the coil 48 remains deenergized throughout operation of the switch assembly 10.

When the pushbutton 14 is manually depressed with the remote switch 92 open, the core 50 and plunger 52 transmit force from the pushbutton plunger 20 to the spring assembly 56. This force effects operation of the switches 16 from the unactuated condition to the actuated condition as the pushbutton 14 is depressed. When the pushbutton 14 is released, the pushbutton moves upward and the spring assembly 56 moves the core 50 upward with the pushbutton. Therefore, when the core 50 and pushbutton 14 move from the position shown in FIG. 4 to the position shown in FIG. 3, the switches 16 are operated from the actuated condition back to the unactuated condition. Since the coil 48 cannot be energized through the open remote switch 92, the switches 16 remain actuated only as long as the pushbutton 14 is manually depressed.

Conclusion

An improved switch assembly 10 includes switch contacts 16 which are operable between unactuated and actuated conditions. At least a portion 50 of an electromagnetic holding device 44 movable from a first position (FIG. 3) to a second position (FIG. 4) by a manually actuatable member 14. An electromagnetic field cooperates with a base member 108 (FIG. 4) to retain the portion 50 of the electromagnetic holding device in the second position.

Upon movement of the portion 50 of the electromagnetic holding device 44 to the second position (FIG. 4), the switch contacts 16 are actuated. The switch contacts 16 are retained in the actuated condition while the portion 50 of the electromagnetic holding device 44 is in the second position (FIGS. 4–8).

The manually actuatable member 14 is movable back to an initial position (FIG. 6) with the portion 50 of the electromagnetic holding device 44 in the second position. A switch 98 is provided to effect operation of the electromagnetic holding device 44 to a deenergized condition upon subsequent actuation of the manually actuatable member 14. This enables the portion 50 of the electromagnetic holding device 44 to move back toward its initial position and the switches 16 to operate to an unactuated condition as the manually actuatable member 14 is returned to its initial position.

Having described the invention, the following is claimed:

1. A switch assembly comprising switch contacts operable between a first condition and a second condition, a base member, electromagnetic means operable between an energized condition and a deenergized condition, said electromagnetic means being effective to provide an electromagnetic field when said electromagnetic means is in the energized condition, manually actuatable means for moving at least a portion of said electromagnetic means toward said base member from a first position in which said portion of said electromagnetic means is spaced from said base member toward a second position in which said portion of said electromagnetic means is adjacent to said base member and the electromagnetic field from said electromagnetic means cooperates with said base member to retain said portion of said electromagnetic means in the second position, means for operating said switch contacts from the first condition to the second condition upon movement of said portion of said electromagnetic means from the first position to the second position and for retaining said switch contacts in the second condition while said portion of said electromagnetic means is in the second position, said manually actuatable means being manually movable from an unactuated position to an actuated position to move said portion of said electromagnetic means toward said base member with said electromagnetic means in the energized condition, said manually actuatable means being movable from the actuated position to the unactuated position with said portion of said electromagnetic means in the second position and said electromagnetic means in the energized condition, and switch means for effecting operation of said electromagnetic means to the deenergized condition upon movement of said manually actuatable means from the unactuated position to the actuated position with said portion of said electromagnetic means in the second position.

2. A switch assembly as set forth in claim 1 further including second switch means for effecting operation of said electromagnetic means from the energized condition to the deenergized condition while said portion of said electromagnetic means is in the second position and said manually actuatable means is in the unactuated position.

3. A switch assembly as set forth in claim 1 wherein said portion of said electromagnetic means is movable away from the second position toward the first position during movement of said manually actuatable means form the actuated position toward the unactuated position with said electromagnetic means in the deenergized condition.

4. A switch assembly as set forth in claim 3 wherein said switch contacts are operable from the second condition to the first condition upon movement of said portion of said electromagnetic means from the second position to the first position.

5. A switch assembly as set forth in claim 4 wherein said switch means is operable to effect operation of said electromagnetic means from the deenergized condition to the energized condition upon movement of said portion of said electromagnetic means from the second position to the first position.

6. A switch assembly as set forth in claim 1 wherein said electromagnetic means includes a coil, said portion of said electromagnetic means including a core which is movable relative to said coil between the first position and the second position, said coil extending around at least a portion of said core when said core is in the first position and when said core is in the second position.

7. A switch assembly as set forth in claim 1 further including switch actuator means for operating said switch means to effect deenergization of said electromagnetic means during movement of said manually actuatable means from the unactuated position to the actuated position with said portion of said electromagnetic means in the second position, and means for rendering said switch actuator means ineffective to operate said switch means during movement of said manually actuatable means from the unactuated position to the actuated position with said portion of said electromagnetic means in the first position upon initiation of movement of said manually actuatable means from the unactuated position.

8. A switch assembly as set forth in claim 7 wherein said switch means includes a fixed contact, a movable contact, a spring urging said movable contact into engagement with said fixed contact, and an actuator member connected with said movable contact, said switch actuator means including a drive element connected with said manually actuatable means, a force transmitting element movable from a retracted condition to an extended condition in which said force transmitting element is disposed adjacent to said actuator member, said drive element being movable by said manually actuatable means to apply force against said force transmitting element when said force transmitting element is in the extended condition to move said movable contact away from said fixed contact against the influence of said spring during movement of said manually actuatable means from the unactuated position to the actuated position with said portion of said electromagnetic means in the second position to thereby effect operation of said electromagnetic means from the energized condition to the deenergized condition.

9. A switch assembly as set forth in claim 8 further including means connected with said portion of said electromagnetic means for retaining said force transmitting element in the retracted condition during at least a portion of the movement of said manually actuatable means from the unactuated position toward the actuated position with said portion of said electromagnetic means in the first position.

10. A switch assembly as set forth in claim 8 wherein a first side portion of said drive element is engageable with said force transmitting element to apply force against said force transmitting element during movement of said manually actuatable means from the unactuated position to the actuated position with said portion of said electromagnetic means in the second position and with said force transmitting element in the extended condition, said force transmitting element being engageable with a second side portion of said drive element during movement of said manually actuatable means from the unactuated position to the actuated position with said portion of said electromagnetic means in the first position upon initiation of movement of said manually actuatable means toward the second position.

11. A switch assembly comprising switch contacts operable between a first condition and a second condition, a coil, a core which is movable relative to said coil, said coil extending around at least a portion of said core and being effective to provide an electromagnetic field when said coil is in an energized condition, manually actuatable means for moving said core relative to said coil from a first position toward a second position, means for operating said switch contacts from the first condition to the second condition upon movement of said core from the first position to the second position and for retaining said switch contacts in the second condition while said core is in the second position, and switch means for effecting operation of said coil between the energized condition and a deenergized condition, said core being movable from the first position to the second position with said coil in the energized condition during movement of said manually actuatable means from the unactuated position to the actuated position, said core being movable away from the second position toward the first position during movement of said manually actuatable means from the actuated position toward the unactuated position with said coil in the deenergized condition, said switch contacts being operable from the second condition to the first condition upon movement of said core from the second position to the first position.

12. A switch assembly as set forth in claim 11 further including second switch means for effecting operation of said coil from the energized condition to the deenergized condition while said portion of said core means is in the second position and said manually actuatable means is in the unactuated position.

13. A switch assembly as set forth in claim 11 wherein said manually actuatable means includes a drive member which applies force against said core to move said core from the first position to the second position with said coil in the energized condition, a force transmitting element movable between a retracted condition and an extended condition, a drive element connected with said drive member and engageable with said force transmitting element to effect actuation of said switch means to deenergize said coil during movement of said manually actuatable means from the actuated position to the unactuated position with said core in the second position.

14. A switch assembly as set forth in claim 13 further including means connected with said core to retain said force transmitting element in the retracted condition during at least an initial portion of movement of said manually actuatable means from the unactuated position toward the actuated position when movement of said manually actuatable means from the unactuated position is initiated with said core in the first position.

15. A switch assembly as set forth in claim 13 wherein said force transmitting element is movable from the retracted condition into engagement with said drive element during movement of said core from the first position to the second position by said manually actuatable means to render said force transmitting element ineffective to actuate said switch means.

* * * * *